United States Patent [19]

Norden

[11] Patent Number: 4,775,338

[45] Date of Patent: Oct. 4, 1988

[54] REJECTION FUSE HOLDERS

[75] Inventor: Alexander R. Norden, New York, N.Y.

[73] Assignee: Connectron, Inc., Laurence Harbor, N.Y.

[21] Appl. No.: 82,445

[22] Filed: Aug. 6, 1987

[51] Int. Cl.[4] ..... H01R 13/64

[52] U.S. Cl. ..... 439/831

[58] Field of Search ..... 439/680, 830, 831, 839

[56] References Cited

U.S. PATENT DOCUMENTS 2,943,295 6/1960 Stewart ..... 439/831

3,927,929 12/1975 Puetz ..... 439/831

*Primary Examiner*—Joseph H. McGlynn

[57] ABSTRACT

The disclosed rejection fuse holder for accepting grooved-terminal cartridge fuses and rejecting ungrooved-terminal cartridge fuses utilizes rejection elements having fuse-engaging edges of special sharpness that dig into and block insertion of ungrooved fuse terminals. In a particularly economical fuse-clip terminal construction, each of a pair of fuse-gripping arms bears a length of wire as the rejection element, carried by its respective arm, with a sharp-edged end facing the direction of fuse insertion, assembled to the fuse-clip arm without resort to a fastening operation.

16 Claims, 1 Drawing Sheet

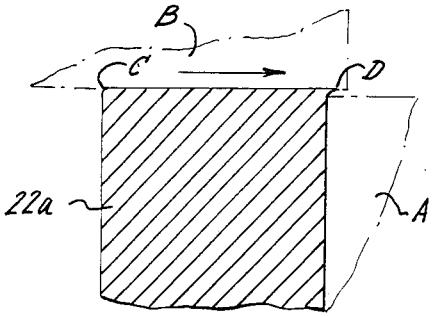
FIG.6
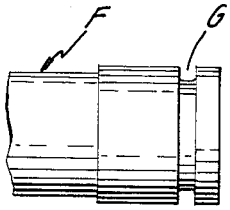
FIG.4
FIG.5
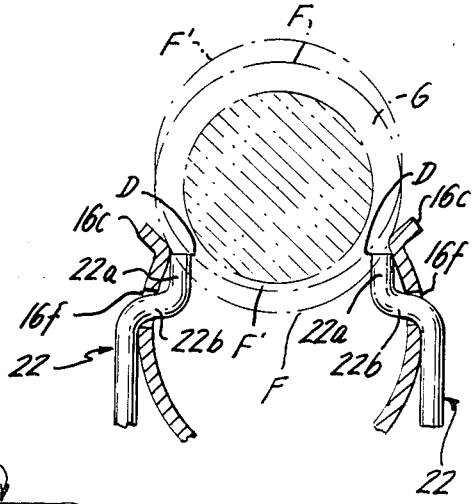
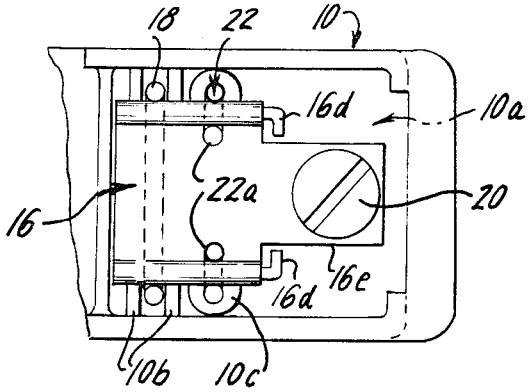
FIG.2
FIG.1
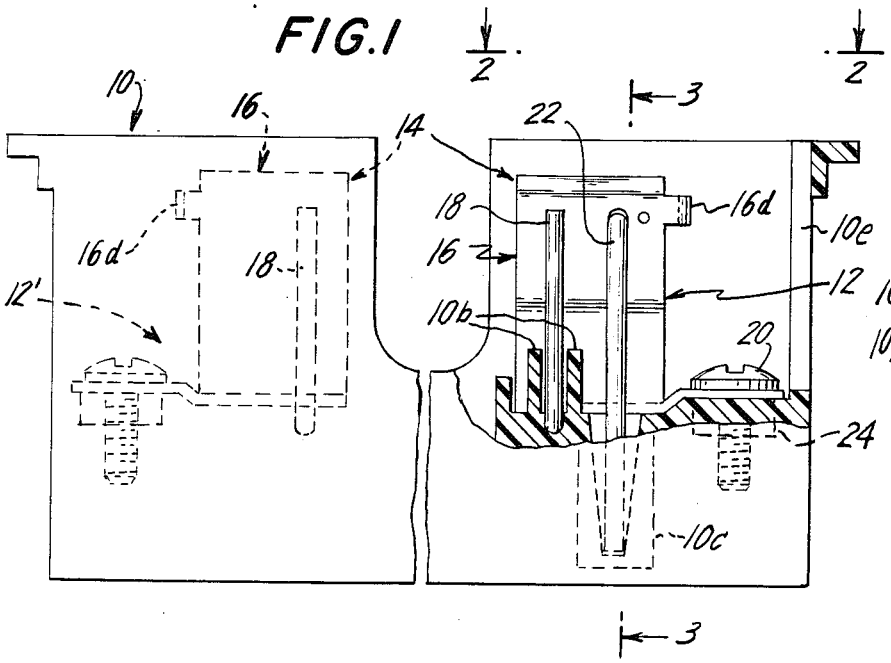
FIG.3
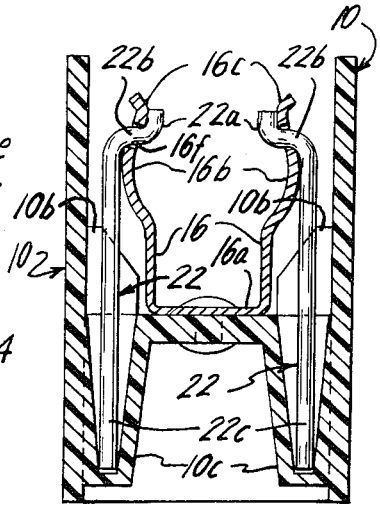

REJECTION FUSE HOLDERS

This invention relates to rejection fuse holders for cartridge fuses.

It has long been standard practice to make fuse holders using fuse clips that provide current-carrying resilient contacts to grip ferrule terminals of both Class H and Class R cartridge fuses. Class H cartridge fuses with ferrule terminals have the same dimensions as Class R fuses of the same current of voltage ratings—as specified in standards of Underwriters Laboratories—but have much lower short-circuit ratings. Those cartridge fuses have ferrule terminals—cylindrical contacts—of equal diameter for the two classes, but a groove encircles one terminal of each Class R fuse.

A fuse holder intended for a circuit that should be limited to a Class R fuse is rendered "non-interchangeable" by incorporation of a rejection element to prevent insertion of a Class H fuse of the same dimensions. Standard UL512 of the Underwriters Laboraties, in particular Sec. 6.19 and its subsections, provides standards for fuse holders for Class R fuses. Other UL standards provide specifications for the fuses. For example, the ferrule terminals of cartridge fuses and of the fuse clips that grip those terminals must provide stable low-resistance electrical contact. It has been standard practice for many decades to make ferrule terminals of cartridge fuses of brass or equivalent metal that provides low-resistance contact.

In one known form of rejection-type cartridge fuse holders, one of the two fuse clips incorporates a rigid rejection element that can enter an encircling groove of a Class R cartridge fuse compatible with the fuse holder; the rejection element is a positive obstruction preventing the insertion of Class H cartridge fuses of the same dimensions as a Class R fuse but which lack a grooved ferrule terminal. In another approach to non-interchangeability of Class H and Class R fuses, a rejection element is fixed to one resilient contact arm or to each arm of a fuse clip, and the fuse holder has walls that flank the fuse-clip arms and allow only limited spreading of the contact arms. When a Class R fuse with its grooved ferrule is being inserted, the rejection element(s) fit(s) into the groove. As the fuse is being inserted, the arms of the fuse clip are cammed apart only slightly. However, the ungrooved ferrule of a Class H fuse requires more spreading of the fuse-clip arms than is allowed by the flanking walls, so that Class H fuses are rejected.

In the illustrative embodiment of the invention, rejection elements are positioned in relation to the respective arms of a fuse clip and proportioned, as usual, to be received in the groove of a ferrule terminal of a Class R fuse. In accordance with one aspect of the invention, the portions of the rejection elements first engaged by an ungrooved ferrule terminal of a Class H fuse (during attempted insertion) are sharp incising edges which dig into the ferrule and block insertion of such fuses. The terms "sharp" and "incising" have special meaning here. A rejection element with sharp incising edges is made of hard metal stock, much harder than the brass ferrules of cartridge fuses. An incising or sharp edge is exemplified by a corner formed by the intersection of a pre-existing surface of the metal stock and a ground surface, or it may be the "burr" intersection of a pre-existing surface of the metal stock with the last-parted side of a shear cut as in a sheet-metal stamping operation. (The term "burr" is a term of reference, to identify the edge where a burr tends to be formed.) The sharp or incising edge is also in contrast to the intrinsic roundness of a nominally sharp corner in the outline of an ordinary metal stamping.

In the illustrative embodiment of the invention, detailed below, the rejection elements are carried by the fuse-clip arms. The rejection elements move with the fuse-clip arms as the arms are being cammed apart somewhat by a Class R cartridge being inserted. When an effort is made to insert a Class H fuse with an ungrooved ferrule terminal, the rejection elements dig into and block insertion of the fuse.

In another aspect of the invention, assembly of a rejection element to a resilient arm of a fuse-clip is carried out in a simple manner, without requiring a fastening operation. As a result, a fuse holder suitable for Class R fuses having rejection elements carried by and movable with the resilient arms of a fuse clip can be assembled of very nearly the same parts and assembly operations as in assembling a Class H fuse holder.

In this aspect of the invention, the rejection element is a wire having three portions in succession, namely a fuse-rejection end portion, a locating portion and an orienting portion. The fuse-rejection portion is disposed in position to enter the groove in the ferrule of Class R fuses and to interfere with Class H fuses. The locating portion of the rejection element extends through a hole in the fuse-clip arm, serving to locate the rejection element in relation to the fuse-clip arm. The orienting portion engages a part of the fuse holder to determine the attitude of the whole rejection element so that the fuse-rejection end portion is properly dispersed in relation to a fuse being inserted.

A rejection element is assembled to each arm of the fuse clip in a simple manner: it is just threaded into the hole in the fuse-clip arm. The orientation of the whole rejection element is fixed by cooperation of the orienting portion with some other portion of the fuse holder.

The exemplary rejection fuse holder disclosed in detail below and shown in the accompanying drawings utilizes both of the foregoing novel aspects, namely, assembly of the rejection element(s) economically to the fuse-clip arm(s) without resort to a fastening operation, and the provision of a fuse clip with rejection element(s) having the special sharpness of edge that is effective for incising ungrooved ferrules of cartridge fuses. As will be seen, the rejection elements of the fuse holder in the illustrative embodiment are supported only resiliently against spreading, yet those rejection elements dig into and dependably reject Class H fuses.

The nature of the invention, its further features and its advantages will be better appreciated from the following description in detail of an illustrative embodiment of the invention shown in the accompanying drawings.

In the drawings:

FIG. 1 is a side elevation of a cartridge fuse holder, a portion of the mounting structure being broken away to show internal components;

FIG. 2 is a fragmentary top plan view of the portion 2—2 of the fuse holder of FIG. 1, FIG. 2 being drawn to the same scale as in FIG. 1;

FIG. 3 is a vertical cross-section of the fuse holder of FIG. 1 at the plane 3—3 of FIG. 1, FIG. 3 being drawn to the scale of FIG. 2;

FIG. 4 is a fragmentary view of a fuse that is compatible with the fuse holder of FIGS. 1–3, drawn to the scale of FIGS. 2 and 3;

FIG. 5 is a fragmentary cross-sectional view of the novel fuse holder of FIGS. 1–3 as seen in FIG. 3 but drawn to larger scale and showing ferrule terminals of a compatible fuse and an incompatible fuse in phantom when each fuse initially engages the novel fuse holder; and FIG. 6 is a greatly enlarged fragmentary cross-section of the top end of a rejection element as seen in FIG. 5, with fragmentary portions of a shearing tool in phantom.

Referring now to the drawings, a mount or body 10 of molded electrical insulation supports two terminal assemblies 12 and 12'. Each of these terminal assemblies includes a fuse clip 14. Each fuse clip comprises a generally U-shaped sheet-metal contact member 16 as of copper or bronze and a U-shaped steel wire spring 18.

Contact member 16 is generally U-shaped as seen in FIG. 3. Its base **16*a* is riveted to mount 10. Upright arms of the contact member include divergent end portions 16*c* and cylindrically curved portions 16*b*** that grip an inserted fuse ferrule of the same curvature.

Wire spring 18 has upstanding legs that are held upright by pairs of formations **10*b* of the insulating mount, and a portion of spring 18 which interconnects the legs is confined in a groove in mount 10 under base portion 16*a* of the contact member. The legs of spring 18 augment the resilient grip of a fuse ferrule by the arms of the contact member 16. The divergent portions 16*c* of contact member 16** act as cams, spreading the contact arms as a fuse is being forced into the fuse holder.

Each contact member 16 has lugs **16*d* that fix the lengthwise position of a cartridge fuse in the fuse holder. An integral extension 16*e* of each contact member bears a terminal screw 20, for a circuit connection that enters mount 10 via opening 10*a***.

The described cartridge fuse holder is exemplary, but details can be modified. For example, contact member 16 may be of suitably resilient metal that may justify omitting U-shaped springs 18. In any case, contact members 16 are of any suitable metal chosen for its contact-making characteristics. All such fuse holders conform to present standards UL512 established by Underwriters Laboratories, Inc.

Cartridge fuses that may be inserted in such fuse holders have cylindrical ferrules complementary to fuse-clip portions **16*b***. Class R cartridge fuses, and Class H fuses of the same dimensions but which lack groove G (FIG. 4), can be inserted into such fuse holders. Fuse holders for Class R fuses include distinctive rejection devices. UL512 Section 6.19 and its subsections provide standards applicable to fuse holders for Class R fuses.

In the fuse holder shown in FIGS. 1, 2, 3 and 5, one of the fuse clips has a pair of rejection elements 22 assembled to the respective arms of a member 16. Each rejection element in this exemplary but illustrative embodiment of the invention consists of a wire made of steel, for example, or any resilient metal much harder than the ferrules of cartridge fuses, in particular harder than brass as specified in Underwriters Laboratories standards for cartridge-fuse ferrules.

Each rejection element includes an end portion **22*a*, an offset portion 22*b* and a tail 22*c*. End portion 22*a* can also be called a fuse rejection portion; it blocks ferrules of fuses F' that fit contact member 16 but which lack the groove G of Class R fuses. Offset portion 22*b* of each member 22 extends through a hole 16*f* in the related arm of contact member 16 so as to provide firm support for the fuse rejection element. The tail or orienting portion 22*c* is confined in a tapered well 10*c* in mount 10; this tail maintains fuse rejection portion 22*a*** facing the direction of fuse insertion.

In producing the fuse holder, the parts 16, 18 and 22 of terminal assembly 12 are assembled to each other without resort to any fastening operations. The assembled parts are placed in the molded mount 10 and, when member 16 has been riveted in place, the parts are all fixed in assembly. The fuse terminal construction is amenable to this economical yet secure assembly procedure. Screw 20 is threaded through the tab extension **16*e* of contact member 16 and into fixed nut 24**.

A fuse is forcibly driven into place between the arms of contact member 16 in the usual manner. A Class R fuse F (as shown in FIG. 4) initially engages flared ends or cams **16*c* of the contact member; the arms of the contact member become spread somewhat, and finally contoured portions 16*b* of the contact member grip the fuse ferrule. During insertion of a fuse, the pair of fuse rejection portions 22*a* shift away from each other, being carried by the outward-deflected arms of contact member 16. There is ample space within mount 10 to accommodate the outward deflection of the contact member's arms bearing rejection elements 22 during insertion of a fuse. Rejection portions 22*a* are received in groove G of fuse F. The first portions of rejection elements 22** initially engaged by an ungrooved fuse ferrule F' (FIG. 5) are sharp, being much harder than the fuse ferrule, and being so formed and angled in relation to the fuse ferrule as naturally to dig into the ferrule and thus prevent insertion of an ungrooved fuse ferrule F'.

It is evident that sharp rejection elements need not be in the form of wires 22. Conversely, rejection elements 22 in the form of wires that are readily assembled to the fuse-clip arms are useful even if the described incising edges were lacking. Thus, wires 22 carried by the fuse-clip arms might be made effective for rejecting Class H cartridge fuses without relying on the described incising edges. For example, the side walls of molded body 10 of insulation may be closer to the fuse-clip arms, spaced apart only enough to allow the fuse-clip arms to spread, as needed, in admitting a grooved Class R cartridge fuse, and in that construction the walls are too close to the fuse-clip arms (and the rejection elements carried by the arms) to allow an ungrooved Class H cartridge fuse to be forced into the space between the fuse-clip arms.

The ends of fuse rejection portions **22*a* might be sharp as a result of being ground flat, to have either an end surface perpendicular to the wire axis (as shown) or ground to form an acute angle between the intersecting surfaces that form a rejection edge for a Class H fuse. More economically than by grinding, the end of wire portion 22*a* can be formed to have a sharp fuse-engaging edge by the shearing operation represented in FIG. 6. There, the wire end is supported by a stationary die or shear part A and the moving cutter B is driven transverse to the wire axis in the direction of the arrow, to trim the end of wire portion 22*a*. A rounded (dull) corner C develops where a cutter B first engages the wire and an intrinsically sharp edge D, a burr, tends to develop on the wire at the end of the shear cut. It is this sharp corner D that first engages the ungrooved ferrule F', for both of the rejection elements in FIG. 5. This is realized by appropriate coordination of the shear operation and the bending operation(s) used in forming properly directed sharp edges D (FIG. 5) on the rejection elements. If each edge D were not effectively sharp (if rounded edges C were to replace sharp edges D), then elements 22 would not serve as incising fuse-rejection elements. The wire of elements 22** is either initially hard or hardness can be imparted after the sharp edge is formed. The same attention should be directed to developing sharp edges D when the rejection element is not formed wire but, instead, of sheet-metal.

The arms of contact member 16 provide firm structural support for the rejection elements 22 in resisting the force imposed on a fuse being inserted, a force that is directed downward in FIG. 3. This support develops where portions **22*b*** of the rejection elements are pressed against the contact member's arms, where they pass through those arms. Thus, while the fuse clips apply only spring pressure against a ferrule of a Class R fuse, the rejection elements, which dig into an ungrooved ferrule, provide virtually positive resistance against an ungrooved fuse being inserted.

The fuse holder of the foregoing description represents the presently preferred construction but of course it can be modified in various ways, some instances being noted above, by those skilled in the art. Consequently, the invention should be construed broadly in accordance with its true spirit and scope.

What is claimed is:

1. A rejection type fuse holder for mounting a compatible cartridge fuse of the type having a pair of ferrule terminals one of which has an encircling groove, and for rejecting cartridge fuses of the same dimensions but which lack such groove, thereby being an incompatible cartridge fuse, said fuse holder comprising a mount of electrical insulation and first and second fuse clips secured to said mount, said fuse clips being located and proportioned for cooperation with both compatible and incompatible cartridge fuses, and rejection means unified with one of said fuse clips, each of said fuse clips having a pair of arms which include respective contact portions shaped and spaced apart for gripping one inserted ferrule terminal and which include spaced-apart arm end portions having leading edges that are engaged by a ferrule terminal being inserted for forcibly camming apart the contact arms, said rejection means comprising a length of wire for each arm, each said length of wire including, in succession, a fuse-rejection end portion, a locating portion, and an orienting portion, said fuse-rejection end portions being located between and close to said arm end portions, said locating portions extending through and being located by said arms, and said orienting portions being constrained so that said fuse-rejection end portions are the first portions of the wire lengths engaged by a ferrule terminal of an incompatible cartridge fuse whose insertion is being attempted.

2. A fuse holder as in claim 1 wherein said locating portion of each length of wire is supported by its respective arm so as to resist forces applied to said fuse-rejection end portions by an incompatible cartridge fuse whose insertion is being attempted.

3. A fuse holder as in claim 1, wherein said mount has formations coacting with said orienting portions of said wire lengths for determining the attitudes of said fuse-rejection end portions.

4. A fuse holder as in claim 1, wherein said lengths of wire are of metal that is much harder than the metal of the ferrule terminals of cartridge fuses, and wherein those parts of said fuse-rejection end portions which are first engaged by a ferrule terminal of an incompatible cartridge fuse whose insertion is being attempted have incising edges disposed and effective for digging into the ungrooved ferrule terminal of such incompatible cartridge fuse.

5. A fuse holder as in claim 3, wherein said lengths of wire are of metal that is much harder than the metal of the ferrule terminals of cartridge fuses, and wherein those parts of said fuse-rejection end portions which are first engaged by a ferrule terminal of an incompatible cartridge fuse whose insertion is being attempted have incising edges disposed and effective for digging into the ungrooved ferrule terminal of such incompatible cartridge fuse.

6. A fuse holder as in claim 4, wherein said incising edges are the result of one of the group of operations consisting of either grinding or shearing the wire of which said lengths of wire are formed.

7. A rejection type fuse holder for mounting a compatible cartridge fuse of the type having a pair of ferrule terminals one of which has an encircling groove and for rejecting cartridge fuses of the same dimensions but which lack such groove, thereby being an incompatible cartridge fuse, said fuse holder comprising a mount of electrical insulation and first and second fuse clips secured to said mount, said fuse clips being located and proportioned for cooperation with both compatible and incompatible cartridge fuses, and rejection means unified with one of said fuse clips, each of said fuse clips having a pair of arms which include respective contact portions shaped and spaced apart for gripping an inserted ferrule terminal and which include spaced-apart arm end portions having cams that are engaged by a ferrule terminal being inserted for forcibly spreading the contact arms, said rejection means comprising a pair of rejection elements of a metal much harder than the metal of ferrule terminals of cartridge fuses, said rejection elements being spaced apart, located and dimensioned for entering the encircling groove of a ferrule terminal of a compatible cartridge fuse being inserted into the fuse holder, and said rejection elements having sharp incising edges that are disposed and effective to engage and dig into an ungrooved ferrule terminal of an incompatible fuse for thereby blocking insertion of an incompatible cartridge fuse.

8. A fuse holder as in claim 7, wherein said incising edges are the result of one of the group of operations consisting of either shearing or grinding the rejection elements to form an end surface thereof.

9. A rejection type fuse holder as in claim 7, wherein each of said rejection elements is a length of wire having a wire end portion that constitutes said incising edges.

10. A rejection type fuse holder as in claim 7, wherein each of said rejection elements is a length of wire having a succession of portions, namely, a fuse rejection portion that provides a said incising edge, a wire-locating portion, and a wire-orienting portion, said rejection portions being disposed between and close to respective ones of said arm end portions, wherein said locating portions extend through and are supported by said arms, respectively, and wherein said orienting portions coact with said mount to dispose said fuse rejection portions so that their incising edges are effective, as aforesaid, to dig into an ungrooved ferrule terminal of a cartridge fuse whose insertion is being attempted.

11. A rejection type fuse holder as in claim 10, wherein said incising edges are the result of one of the group of operations consisting of either grinding or shearing the wire of which said lengths of wire are formed.

12. A terminal structure for a rejection type of fuse holder for compatible cartridge fuses of the type having a pair of ferrule terminals one of which has an encircling groove and for rejecting cartridge fuses of the same dimensions lacking such groove and thus being incompatible, said terminal structure including a fuse clip for a ferrule terminal, a mount supporting said fuse clip, and rejection means for rejecting ferrule terminals of said incompatible fuses, said fuse clip having a pair of arms which include respective contact portions shaped and spaced apart for gripping an inserted ferrule terminal and which include spaced-apart arm end portions having leading edges that are engaged by a ferrule terminal being inserted for forcibly camming apart said arms, said rejection means comprising a pair of rejection elements of a metal much harder than the metal of ferrule terminals of cartridge fuses, said rejection elements being spaced apart, located and dimensioned for entering the encircling groove of a ferrule terminal of a compatible cartridge fuse being inserted into the fuse holder, and said rejection elements having sharp incising edges that are disposed and effective to engage and dig into an ungrooved ferrule terminal of an incompatible fuse for thereby blocking insertion of an incompatible cartridge fuse.

13. A terminal structure as in claim 12, wherein said fuse clip comprises a U-shaped sheet-metal member forming said arms and comprises a base portion interconnecting said arms and secured to said mount, said sheet-metal member providing said arms with spring bias for gripping a ferrule terminal, said arms supporting said rejection elements so that the rejection elements move with said arms as the latter are spread by a ferrule terminal of a compatible fuse being inserted, said arms restraining the spread of the rejection elements when forcible insertion of an ungrooved ferrule terminal is attempted.

14. A terminal structure as in claim 13, wherein said fuse clip further includes a U-shaped spring embracing said arms and augmenting the spring bias of said arms against an inserted ferrule terminal.

15. A terminal structure as in claim 12, wherein each of said rejection elements has a succession of portions, namely, a fuse rejection portion that provides a said incising edge, a wire-locating portion, and a wire-orienting portion, said rejection portions being disposed between and close to respective ones of said arm end portions, wherein said locating portions extend through and are supported by said arms, respectively, and wherein said orienting portions coact with said mount to dispose said fuse rejection portions so that their incising edges are effective, as aforesaid, to dig into an ungrooved ferrule terminal of a cartridge fuse whose insertion is being attempted.

16. A terminal structure as in claim 12, wherein said incising edges are the result of one of the operations consisting of either shearing or grinding the rejection elements to form an end surface thereof.

* * * * *